US006648675B2

(12) United States Patent
Welschholz et al.

(10) Patent No.: US 6,648,675 B2
(45) Date of Patent: Nov. 18, 2003

(54) METHOD FOR FITTING AN OBJECT WITH A CABLE HARNESS COMPRISING AT LEAST ONE FLAT CONDUCTOR, AND ELECTRIC/ELECTRONIC DEVICES CONNECTED THERETO

(75) Inventors: Jorg Welschholz, Herscheid (DE); Roland Drees, Bonen (DE); Norbert Bendicks, Hemer (DE); Detlef Kerkmann, Nachrodt (DE); Berthold Eesders, Schalksmuhle (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 0 days.

(21) Appl. No.: 10/185,461

(22) Filed: Jun. 28, 2002

(65) Prior Publication Data

US 2003/0008534 A1 Jan. 9, 2003

Related U.S. Application Data

(63) Continuation of application No. PCT/EP01/11112, filed on Sep. 26, 2001.

(30) Foreign Application Priority Data

Sep. 30, 2000 (DE) ..... 100 48 693

(51) Int. Cl.[7] ..... H01R 12/24

(52) U.S. Cl. ..... 439/492; 439/77; 439/67; 439/493; 439/494

(58) Field of Search ..... 439/492, 495, 439/496, 77, 67, 329, 493, 494

(56) References Cited

U.S. PATENT DOCUMENTS

| | | | | | |
|---|---|---|---|---|---|
| 4,573,752 | A | * | 3/1986 | Rich | 439/77 |
| 4,717,357 | A | | 1/1988 | Greenwood | |
| 5,044,980 | A | | 9/1991 | Krumme et al. | |
| 5,069,625 | A | * | 12/1991 | Brandt | 439/404 |
| 5,147,208 | A | * | 9/1992 | Bachler | 439/67 |
| 6,033,234 | A | | 3/2000 | Wang et al. | |
| 6,088,241 | A | * | 7/2000 | Hulsmann et al. | 361/826 |
| 6,118,666 | A | | 9/2000 | Aoki et al. | |
| 6,247,951 | B1 | | 6/2001 | Di Liello et al. | |
| 6,394,833 | B1 | * | 5/2002 | Bulmer et al. | 439/393 |

* cited by examiner

*Primary Examiner*—P. Austin Bradley
*Assistant Examiner*—Edwin A. León
(74) *Attorney, Agent, or Firm*—Brooks & Kushman P.C.

(57) ABSTRACT

A method for fitting a carrier with a cable harness having main and branch conductors and with a device. A contact element is arranged on the carrier. A top portion of the main conductor, a bottom portion of a first end of the branch conductor, and a top portion of a second end of the branch conductor are exposed. The conductors are arranged on the carrier with the main conductor lying on the carrier, the exposed bottom portion of the branch conductor contacting the exposed top portion of the main conductor, and the exposed top portion of the branch conductor placed on the contact element for realizing a plug connector. The carrier is fitted with a device having a plug connector such that the device is electrically connected to the branch conductor and mechanically connected to the carrier via a connection between the plug connector and the contact element.

13 Claims, 6 Drawing Sheets

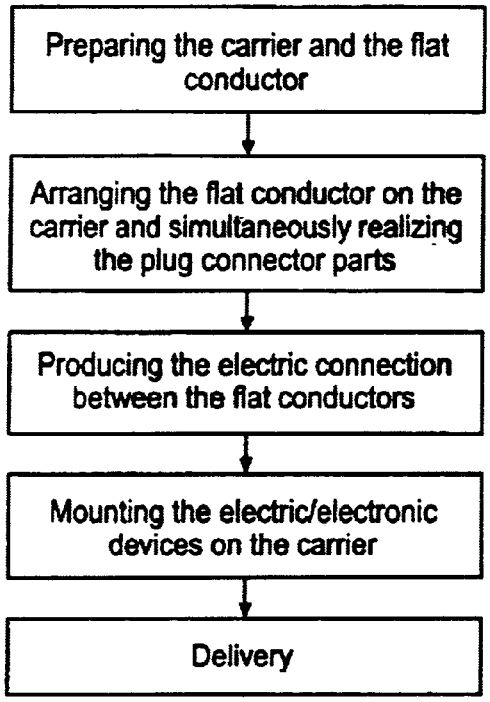
*Fig.* 1A
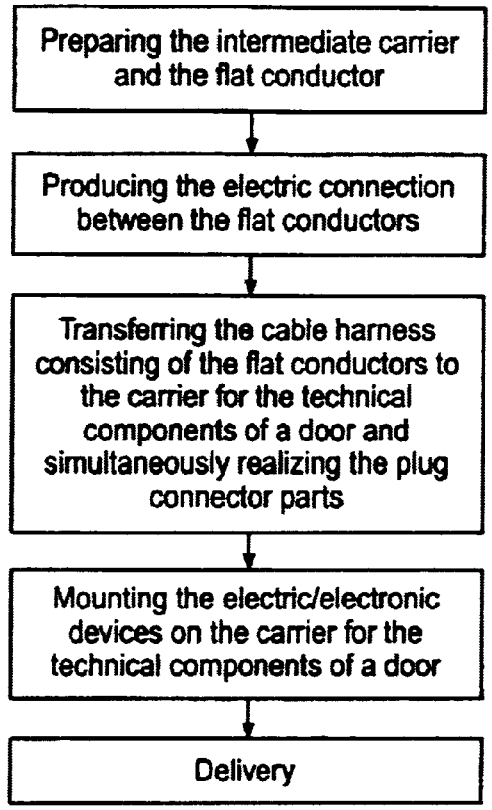
*Fig.* 1B

METHOD FOR FITTING AN OBJECT WITH A CABLE HARNESS COMPRISING AT LEAST ONE FLAT CONDUCTOR, AND ELECTRIC/ELECTRONIC DEVICES CONNECTED THERETO

CROSS-REFERENCE TO RELATED APPLICATIONS

This is a continuation of International Application PCT/EP01/11112, published in German, with an international filing date of Sep. 26, 2001.

BACKGROUND OF THE INVENTION

1. Field of the Invention

The invention pertains to a method for fitting an object with a cable harness that consists of at least one flexible flat conductor and with electric/electronic devices connected to the at least one flat conductor, as well as a utilization of such a method. The invention furthermore pertains to a system with several electric/electronic devices, with a cable harness that consists of at least one flexible flat conductor and with an object to be fitted with the electric/electronic devices.

2. Background Art

Certain objects need to be fitted with electric and/or electronic devices for numerous applications, wherein the devices are connected to one another or to an existing system with their external connections. If the object with its devices should be connected to another unit or an existing system, a connecting plug is integrated into the electric wiring. Depending on the design of the object, the devices and the intended fitting method, the object is initially fitted with the at least one flat conductor and then with the devices to be mounted thereon. The electric contacts between the devices and the individual conductors of the conductor set are realized with the aid of plug connectors, wherein the conductor ends of a flat conductor section which need to be contacted carry a corresponding plug connector part—that is realized in the form of either a plug or a socket. The electric connections between the conductors and the electrically conductive parts of the plug connector parts arranged on the end of a conductor is usually realized in the form of a crimp connection or with the aid of a joining method.

Flat ribbon-types cables—so-called flexible film conductors—are increasingly utilized as conductor sets for, in particular, fitting larger objects. When equipping larger objects with the required electric/electronic devices, for example, the carrier for the technical components of a door, the flat conductors or the cable harnesses consisting thereof are difficult to handle in the desired arrangement and configuration due to their size and flaccid flexural characteristics. In order to realize such a cable harness, a section of a flat conductor containing the sufficient number of electric conductors is cut to the required size, with the desired configuration of the cable harness being achieved by bending certain flat conductor branches. However, this process is complicated and associated with the risk of breaking the conductors at the bending points when the bends are produced in order to achieve the desired change in direction of a flat conductor branch. This is the reason why this bending process needs to be carried out very carefully.

The mechanized manufacture of such a cable harness consisting of a large flat conductor section can only be realized with an unjustifiably high expenditure. In addition, all conductors of the cable harness have the same cross-sectional surface such that current-bearing lines and signaling lines cannot be assembled together. It would also be possible to manufacture such a cable harness by connecting individual flat conductors that, if applicable, may also have different dimensions and may be assembled differently by means of suitable connectors, for example, jumper connectors. However, this would require that all conductors of the individual flat conductors which need to be electrically connected to one another be equipped with such connectors.

The aforementioned problems in the complicated handling of such a cable harness can (theoretically) be prevented if the objects are equipped with the required electric lines in accordance with the so-called MID-technique (Moulded Interconnect Device). In this method, the strip conductors are usually applied onto the object by means of a printing process. Small openings, into which a contact pin is soldered, serve for contacting the devices arranged on the object. This contact pin can then be contacted by means of a plug connector. However, the MID-technique is not suitable for fitting large objects, in particular, if the cross-sectional surface of the conductors used should have a certain size as is, for example, the case with the cable harness assigned to a carrier for the technical components of a motor vehicle door.

SUMMARY OF THE INVENTION

Based on the previously discussed state of the art, the invention aims to develop a method for fitting an object of the initially described type which not only makes it possible to fit larger objects with, if so required, different flat conductors in order to realize a cable harness, but can also be easily and economically carried out with only a few steps, namely even when handling cable harnesses with highly flaccid flexural characteristics.

The invention also aims to develop a system of the initially described type which makes it possible to fit, if so required, larger objects with individually designed cable harnesses consisting of flat conductors by simple means and with justifiable expenditure.

The objective of the invention is attained due to the fact that, in order to realize the respective plug connector parts for contacting the electric/electronic devices to be mounted thereon, the object contains an element for realizing one part of the plug connector, and the electric/electronic devices to be mounted contain a complementary plug connector part.

In one embodiment of the invention, the object, for example, a carrier for the technical components of a door, serves as the mounting table and workpiece carrier, onto which at least one flat conductor of the intended size is placed and fixed in its intended configuration in order to realize a cable harness. Since the cable harness that, if so required, may also have a large size is actually placed directly onto the object, an isolated handling of the cable harness alone, e.g., from another support surface onto the object, is avoided. The sections of the flat conductors which need to be contacted with the electric/electronic devices are stripped before the flat conductor is arranged on the object, preferably on only one side. The conductors in the flat conductor section which need to be contacted are exposed in this fashion.

However, the object not only serves as the mounting table, but also contains elements for realizing one part of the plug connector by utilizing the stripped flat conductor sections. These sections of the flat conductors are arranged on the object such that they extend over such an element. The elements for realizing the plug connector may, for example, consist of a contact segment that protrudes from the object if the object should contain a male plug connector part. However, if the object should contain a female plug connector part, the element may consist of a square opening in the object.

The electric/electronic devices used respectively contain a complementary plug connector part that is realized in the form of a socket for contacting a male plug connector part situated on the object or in the form of a male plug connector part that is inserted into the opening in the object. In the latter instance, the section of the film conductor which lies on the opening is also drawn into the opening during the inserting process such that the opening with the loop-like flat conductor section held therein subsequently forms a socket. The electric/electronic devices are suitably mounted on the object, for example, by means of screw connections or clip-on connections.

In another embodiment of the invention, the cable harness is not produced on the object, but rather on a intermediate carrier. In this case, the surface of the intermediate carrier on which several flat conductors are usually arranged has a negative surface in reference to the surface of the object to be fitted. The utilization of such an intermediate carrier is sensible in instances in which the realization of the cable harness on the object requires steps that possibly could damage the object.

For example, an intermediate carrier is used if individual flat conductors or the electric conductors contained therein should be connected to one another by means of a joining method, for example, laser welding or ultrasonic welding, in order to realize the desired cable harness. When carrying out such a joining method, it must be possible to access the location at which the joint is produced from both sides. In this case, the intermediate carrier may contain an opening at these locations. However this is undesirable with certain objects, for example, a carrier for the technical components of a door.

Due to the design of the intermediate carrier with a negative, complementary surface in reference to the surface of the object to be fitted, the cable harness produced on the intermediate carrier can be easily transferred to the object by joining the intermediate carrier with the cable harness and the object such that the cable harness produced on the intermediate carrier is arranged between the two elements similar to a sandwich. The object comprises suitable connecting means for ensuring that the cable harness remains on the object when the two elements are separated from one another. For example, the object may contain adhesive spots to which the flat conductor adheres. Other types of connections would also be conceivable, for example, snap-on or clip-on connections.

The cable harness that is arranged on the intermediate carrier in its final configuration is transferred to the object to be fitted. This means that the intermediate carrier represents a tool for fitting an object that is realized in the form of a formed part. It would also be conceivable to arrange on the intermediate carrier the electric/electronic devices that are to be subsequently placed on the object or formed part. Such an arrangement primarily appears practical if an object should be fitted in several planes that lie on top of one another because the intermediate carrier respectively provides a working surface and the transfer to the object only takes place once the installation and wiring of this layer is finished.

The intermediate carrier may also be used for, in particular, realizing three-dimensional cable harnesses. In this case, the intermediate carrier serves for realizing the corresponding three-dimensional configuration of the cable harness during the transfer, i.e., after it was arranged as intended in the plane of the intermediate carrier. In this case, the process of joining the two elements is simultaneously used for deforming the cable harness in the third dimension.

The plug connector parts for contacting the electric/electronic devices which utilize the flat conductors are preferably also arranged on the object to be fitted with the cable harness. The intermediate carrier contains a negative structure that correspond to the design of the plug connector part assigned to the object.

The description of the invention makes it clear that the invention is suitable for fitting objects with decentralized devices if the cable harness should be composed of several individual flat conductors. The sections provided for connecting the electric conductors of the individual flat conductors, for example, by means of a joining method, are correspondingly stripped beforehand and arranged on the object or the intermediate carrier in an overlapping fashion in these regions such that the object or the intermediate carrier can be used as a stable work surface when transporting the individual joining positions to, for example, an automated ultrasonic welding device instead of having to handle the individual ends or sections of the flexible film conductors.

The arrangement of the individual sections on the object or the intermediate carrier is advantageous when angled or, in particular, oblique-angled conductor branches of a central flat conductor section should be produced, namely because the individual flat conductor sections are already arranged as intended and can be transported to the automated joining device in this configuration. Branches that are not realized with the intended angle make it necessary to bend the flat conductor branch in order to reach the electric/electronic device to be contacted. This means that the flat conductor branch no longer flatly adjoins the surface of the object. However, this is prevented with the method according to the invention.

The individual steps of the method may also be carried out at different locations and without a chronological correlation due to the fact that a work surface is provided on which the cable harness can be arranged in its intended configuration—for example, the object itself or the intermediate carrier—because the cable harness or its individual flat conductor sections is/are fixed on the object or the intermediate carrier.

The methods according to the invention are particularly suitable for fitting larger objects with electric/electronic devices in a decentralized fashion. This is the reason why one preferred utilization of this method pertains to a carrier for the technical components of a motor vehicle door.

In addition to the required electric/electronic devices and the flexible flat conductors for realizing the cable harness, the core of the claimed fitting system consists of the object to be fitted which contains elements for realizing one part of a plug connector for contacting the devices with the flat conductors, namely by respectively utilizing a flat conductor section. The element assigned to the object may, for example, be realized in the form of a contact segment that protrudes from its surface if the devices should be contacted with a male plug connector part. However, if the devices should be contacted with a female plug connector part, the object contains corresponding openings, into which a male plug connector part of a device can be inserted while simultaneously drawing in the flat conductor section situated on the opening during the inserting process.

Due to this measure, the devices are directly contacted by the electric conductors contained in the flat conductor branch without having to additionally equip these conductors with corresponding plug connector parts. This type of contact correspondingly results in less electric junctions in comparison with the prior state of the art.

The system may also comprise an intermediate carrier with a negative surface in reference to the surface of the object to be fitted, wherein the cable harness consisting of individual flat conductors is arranged and configured on this intermediate carrier.

BRIEF DESCRIPTION OF THE DRAWINGS

The invention is described below with reference to embodiments that are illustrated in the FIGS.

FIGS. 1A and 1B illustrate two flow charts describing the general steps of two alternative methods for fitting a carrier with flat conductors and electric/electronic devices in accordance with the present invention;

DETAILED DESCRIPTION OF THE PREFERRED EMBODIMENT(S)

FIGS. 1A and 1B illustrate two different variations of a method for fitting a carrier with decentralized electric/electronic devices and with a cable harness that consists of individual flexible flat conductor sections. In this case, the method shown in FIG. 1A uses a carrier, on which all steps are carried out. In the method shown in FIG. 1B, an intermediate carrier is used.

Figure 2A:
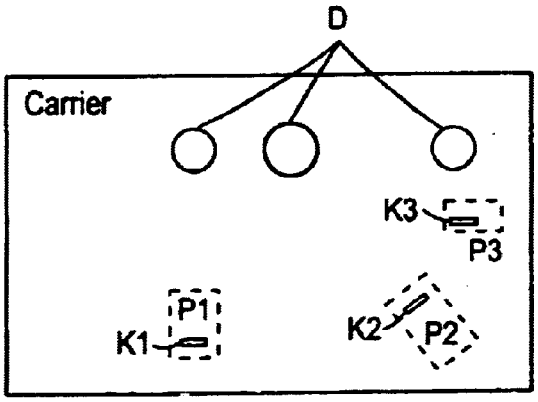
FIGS. 2A and 2B illustrate a schematic top view of a carrier that is to be fitted with flat conductors and different electric/electronic devices.
Figure 2B:
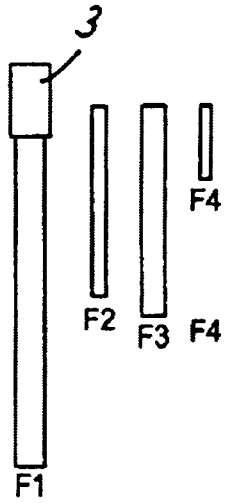

In the first step of the first-mentioned method, correspondingly assembled flat conductor sections $F_1$–$F_4$ and a carrier 1 that, for example, may consist of the carrier for the technical components of a door (see FIGS. 2A and 2B) are prepared. The flat conductor sections $F_1$–$F_4$ consist of flexible film conductors that contain copper conductors which are arranged parallel to and spaced apart from one another between two polyester films that serve as an insulator. The flexible film conductors are unwound from reels and cut to the required length. The two ends of the flat conductor sections $F_2$–$F_4$ are respectively stripped on opposite upper surfaces such that the conductors contained in the flat conductor sections $F_2$–$F_4$ are exposed at the respective upper surfaces. The flat conductor section $F_1$ forms the electric main of the cable harness 2 to be produced from the flat conductor sections $F_1$–$F_4$ and is stripped on its upper side in the regions of the sections in which the flat conductor branch sections $F_2$–$F_4$ are provided, namely relative to those conductors which should electrically contact the conductors contained in the respective flat conductor sections $F_2$–$F_4$.

The carrier 1 contains three openings D that serve for inserting a welding apparatus. Predetermined positions $P_1$–$P_3$ on the carrier 1 indicate the locations at which three electric/electronic devices should be positioned. A contact segment $K_1$–$K_3$ is arranged in each position $P_1$–$P_3$ such that it protrudes from the surface of the carrier 1 that is realized in the form of a rigid, flat plate. The contact segments $K_1$–$K_3$ serve—as described in greater detail below—for realizing a male plug connector part by utilizing the stripped ends of the flat conductor sections $F_2$–$F_4$.

Figure 3:
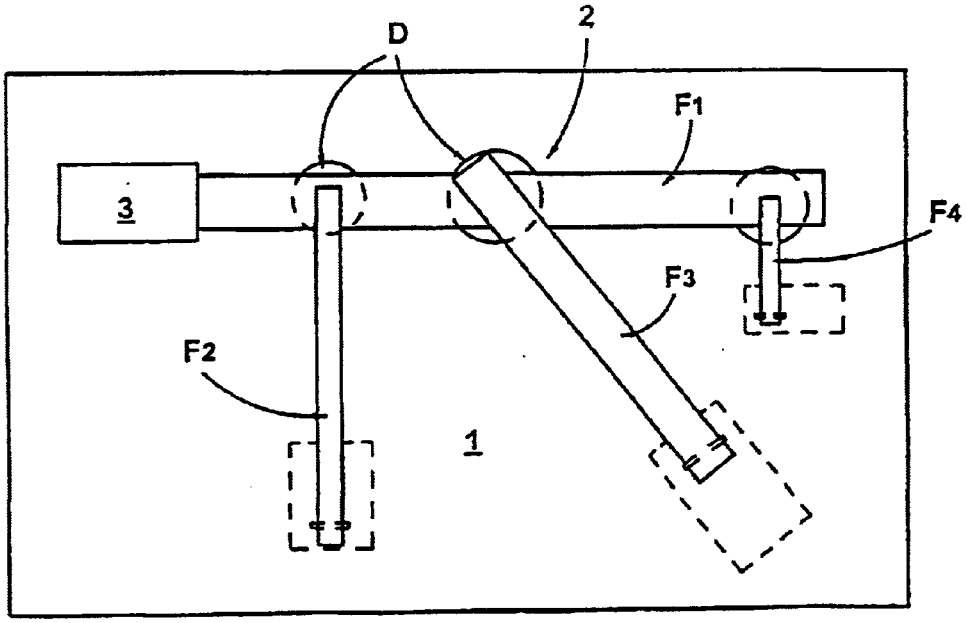
FIG. 3 illustrates the carrier shown in FIG. 1 with several flexible flat conductors arranged thereon.

After the correspondingly assembled flat conductor sections $F_1$–$F_4$ and the carrier 1 have been prepared, the carrier 1 is fitted with the individual flat conductor sections $F_1$–$F_4$ (see FIG. 3). Initially, the flat conductor section $F_1$ is placed onto the carrier 1 such that its stripped sections point away from the surface of the carrier 1. The flat conductor section $F_1$ is arranged on the openings D in the carrier 1 in such a way that the sections which are stripped on the upper side are arranged within the openings D. The other flat conductor sections $F_2$–$F_4$ serve for realizing branches that originate at the flat conductor section $F_1$. The flat conductor sections $F_2$–$F_4$ are placed onto the carrier 1 such that their stripped sections for realizing the plug connector parts together with the contact segments $K_1$–$K_3$ point upward and overlap the flat conductor section $F_1$. The conductors of the flat conductor sections $F_2$–$F_4$ which are exposed on the underside now lie on the predetermined exposed conductors of the flat conductor section $F_1$.

In order to connect the conductors of the flat conductor section $F_1$ to those of the flat conductor sections $F_2$–$F_4$, the carrier 1 is transported to an automated welding device in which the conductors assigned to an opening D are successively welded together. Depending on the desired joining method, a soldering paste is applied onto the exposed conductors of the flat conductor section $F_1$ after fitting the carrier 1 with the flat conductor section $F_1$ and before the flat conductor sections $F_2$–$F_4$ are arranged on the object in the form of branches.

After the respective electric conductors are contacted, the cable harness 2 consisting of the individual flat conductor sections $F_1$–$F_4$ is finished. The flat conductor section $F_1$ was already equipped with a plug part 3 for connecting the cable harness 2 beforehand.

The individual flat conductor sections $F_1$–$F_4$ are preferably fixed on the carrier 1, for example, by means of adhesive spots or clip-on or snap-on connections. This fixing of the individual flat conductor sections $F_1$–$F_4$ was already carried out while they were arranged on the carrier 1.

Figure 4:
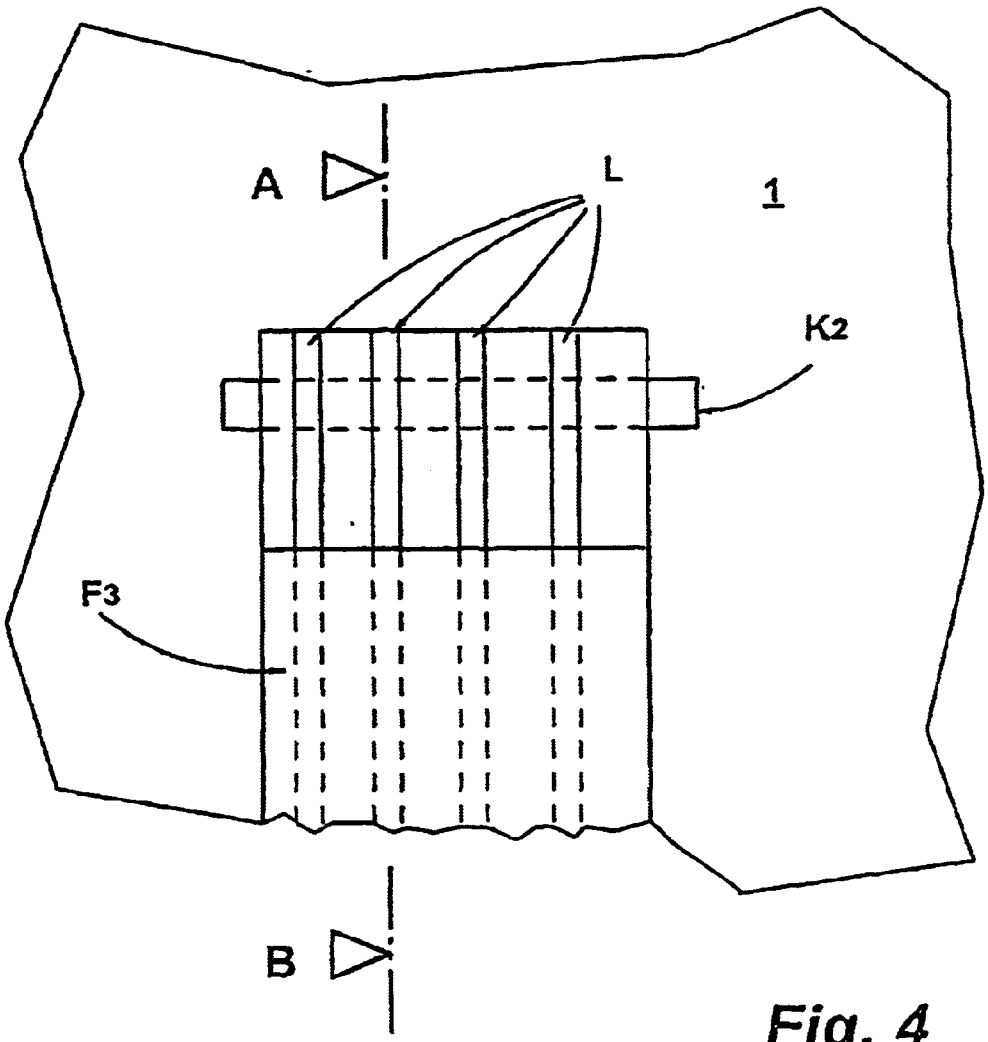
FIG. 4 illustrates an enlarged representation of the end section of a flat conductor shown in FIG. 3.
Figure 5:
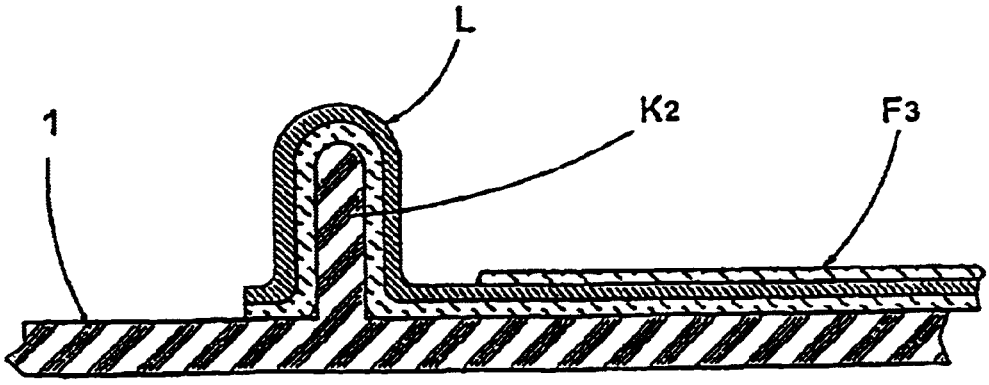
FIG. 5 illustrates a section through the arrangement shown in FIG. 4 along line A–B shown in FIG. 4.

FIG. 4 shows an enlarged representation of the free end of the flat conductor section $F_3$. In this case, the arrangement is shown of the flat conductor section $F_3$ that is stripped on its upper side relative to the contact pin $K_2$ situated underneath; this applies corresponding to the ends of the other flat conductor sections $F_2$ and $F_4$. The longitudinal section through the arrangement according to FIG. 4 which is shown in FIG. 5 makes it clear that the stripped end of the flat conductor section $F_3$ surrounds the contact segment $K_2$ that upwardly protrudes from the carrier 1 such that a male plug connector part with four adjacent contact tabs formed by the conductors L of the flat conductor section $F_3$ is achieved. The connection between the underside of the flat conductor section $F_3$ and the contact segment $K_2$ may, for example, be fixed by means of an adhesive or a holding ring that is approximately attached in the region of the groove. The description of the subsequent fitting of the carrier plate 1 which is provided below will indicate that this connection merely requires the section of the flat conductor section $F_3$ which surrounds the contact segment $K_2$ to approximately remain in the position shown in FIG. 5.

Figure 9:
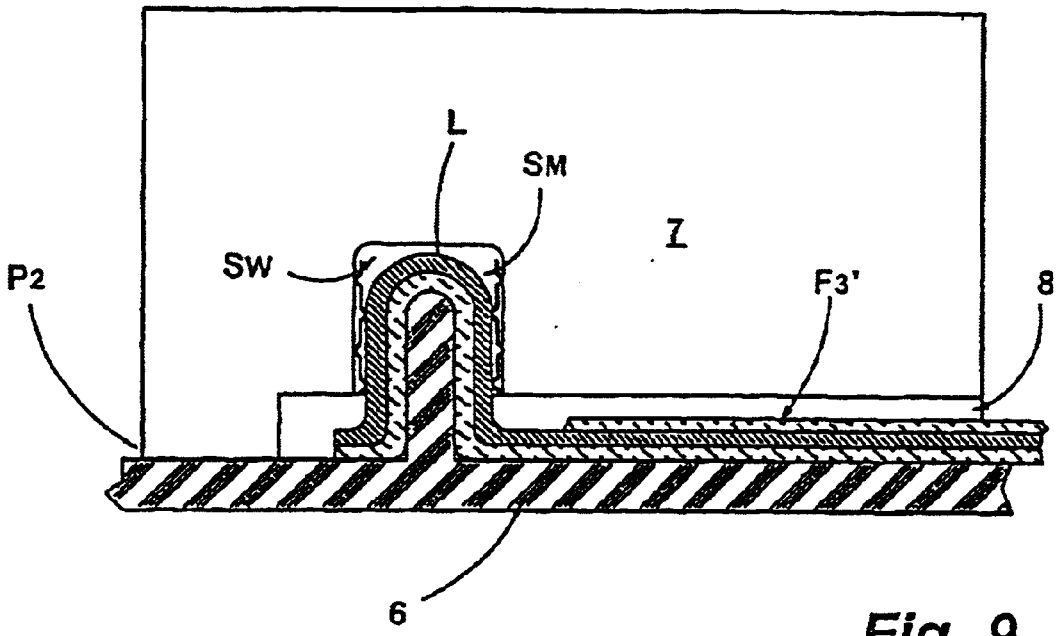
FIG. 9 illustrates a schematic cross section through a plug connector part assigned to the carrier for the technical components of a door with an electric/electronic device arranged thereon, and FIG. 10 illustrate a schematic top view of the finished, fitted carrier for the technical components of a door.

The carrier 1 that was fitted with the cable harness 2 in this fashion is then fitted with the electric/electronic devices in the positions $P_1$–$P_3$ (see the description of FIGS. 9 and 10 below).

Figure 6:
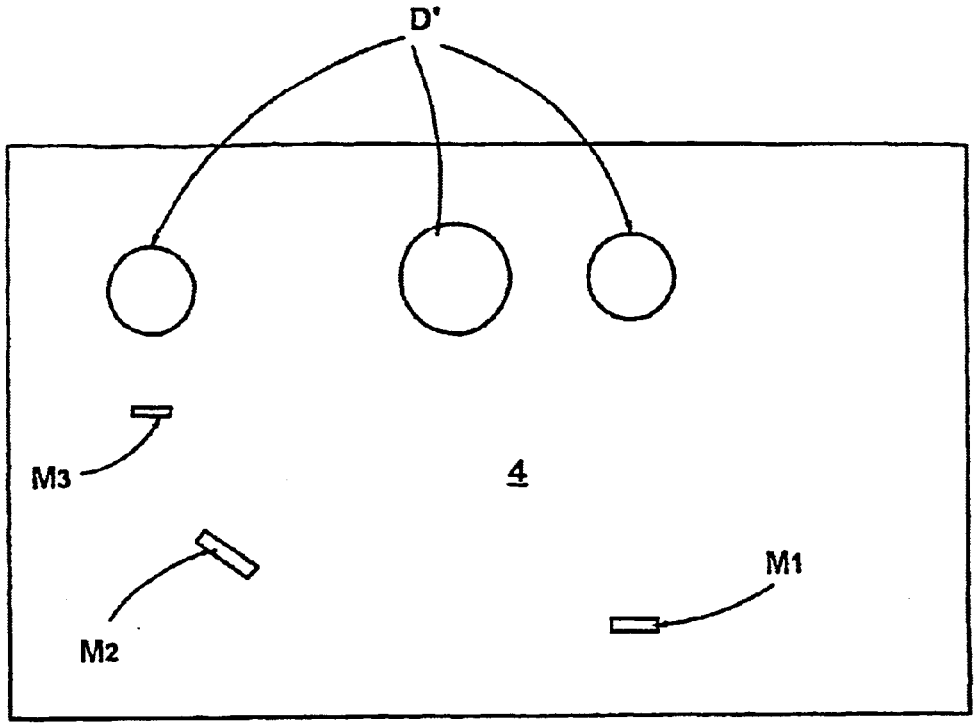
FIG. 6 illustrates a schematic top view of an intermediate carrier for fitting a carrier for the technical components of a motor vehicle door with a cable harness consisting of individual flexible flat conductors and with electric/electronic devices.

In order to arrive at this step, it is, for example, possible to utilize an intermediate carrier 4 according to FIG. 6 on which a cable harness 5 is arranged and configured if the carrier does not contain openings as described above with reference to the embodiment according to FIGS. 1–5. The surface of the intermediate carrier 4 on which the cable harness is fitted represents a negative surface in reference to the surface of the object to be fitted which consists of a carrier 6 for the technical components of a door in this embodiment.

Since the configured cable harness 5 is transferred from the intermediate carrier 4 to the carrier 6 for the technical components of a door in this method, the required arrangements on the intermediate carrier 4 are realized in a laterally reversed fashion in reference to the arrangement on the carrier 6 for the technical components of a door. The intermediate carrier 4 also contains openings D' for attaching an automatic welding device. The intermediate carrier 4 contains installation slots $M_1$–$M_3$ at the locations at which male plug connector parts should be realized on the carrier 6 for the technical components of a door by utilizing the free ends of flat conductor sections. Flat conductor sections $F_{1'}$–$F_{4'}$ are also used for fitting the intermediate carrier 4 in this case.

Figure 7:
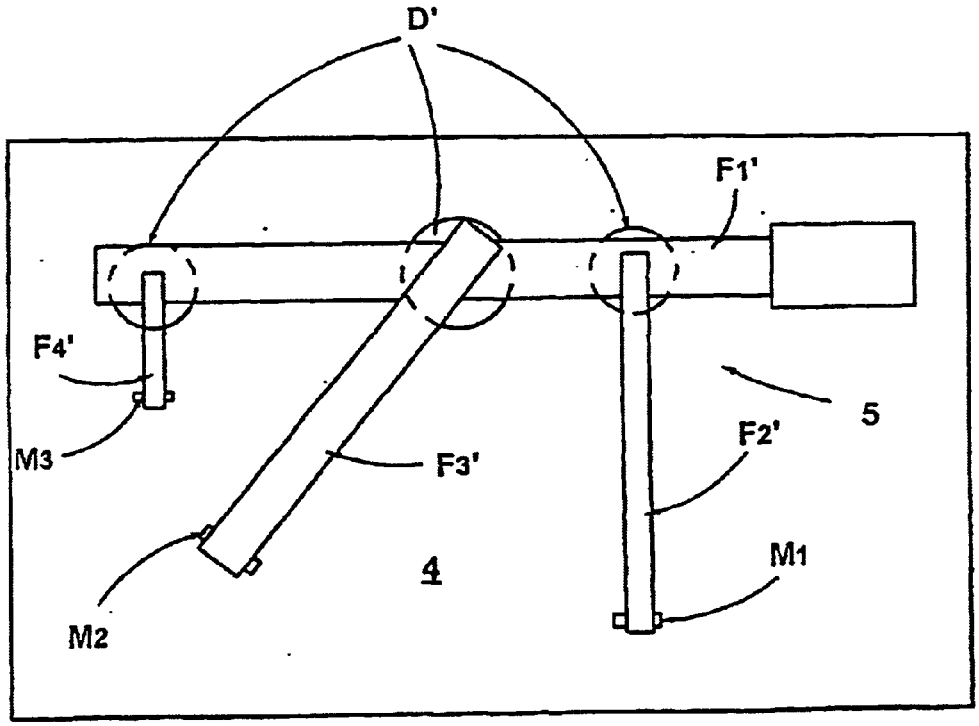
FIG. 7 illustrates the intermediate carrier shown in FIG. 6 with several individual flat conductors arranged thereon.

In contrast to the fixed arrangement of the individual flat conductor sections $F_1$–$F_4$ on the carrier 1, the flat conductor sections $F_{1'}$–$F_{4'}$ are, when utilizing an intermediate carrier 4, only fixed on the intermediate carrier 4 to such a degree that they can be easily separated from the intermediate carrier 4 during the subsequent transfer. The arrangement of the flat conductor sections $F_{1'}$–$F_{4'}$ (see FIG. 7) is realized analogous to the previously described embodiment, wherein the two ends of the flat conductor sections $F_{2'}$–$F_{4'}$ that represent branches of the flat conductor section $F_{1'}$ are stripped on the same upper side in order to contact the corresponding conductors of the flat conductor section $F_{1'}$ and to realize the desired plug connector part.

The electric connection between the conductors of the flat conductor section $F_{1'}$ and the conductors of the flat conductor sections $F_{2'}$–$F_{4'}$ is subsequently produced by means of a joining method.

Figure 8A:
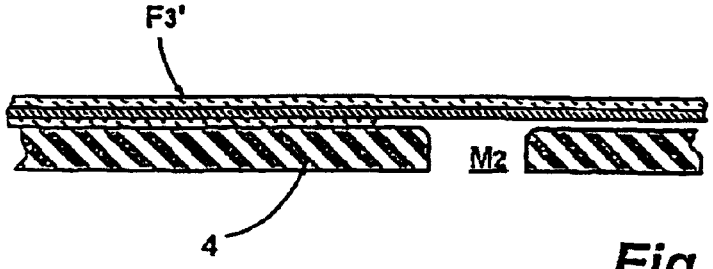
FIGS. 8A, 8B, 8C, and 8D illustrate the individual steps for realizing a male plug connector part assigned to the carrier for the technical components of a door by utilizing the intermediate carrier shown in FIG. 6.
Figure 8B:
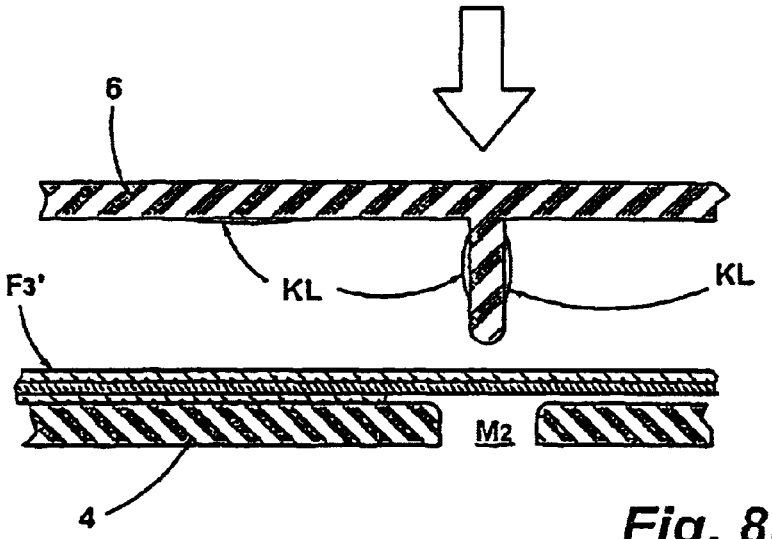
Figure 8C:
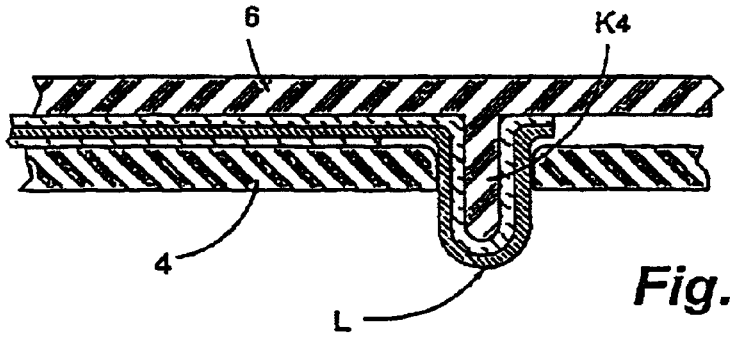
Figure 8D:
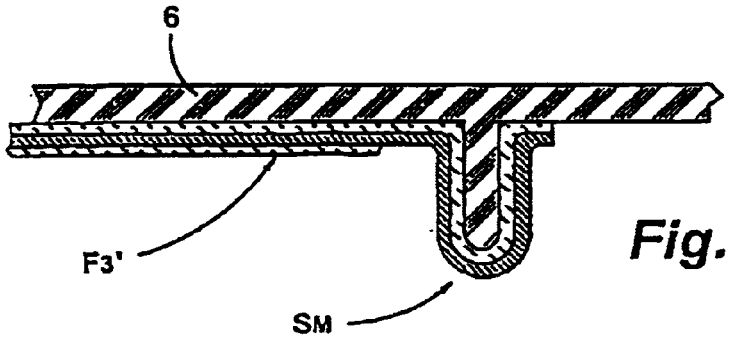

The transfer of the finished cable harness 5 to the carrier 6 for the technical components of a door is illustrated in FIGS. 8*a*–8*d* in the form of an enlargement of the region of the installation slot $M_2$. The transfer of the cable harness 5 to the carrier 6 for the technical components of a door is realized by joining the intermediate carrier 4 with the cable harness 5 and the carrier 6 for the technical components of a door as schematically indicated in FIG. 8*b*. The carrier 6 for the technical components of a door contains a contact segment $K_4$, the two lateral upper surfaces of which are respectively provided with an adhesive spot KL; another adhesive spot KL is situated on the underside of the carrier 6 for the technical components of a door in the region in which the film conductor section $F_{3'}$ needs to be positioned. The installation slot $M_2$ of the intermediate carrier 4 represents a negative of the contact segment $K_4$, into which the contact segment $K_4$ is inserted as the corresponding positive when joining the intermediate carrier 4 and the carrier 6 for the technical components of a door. When the contact segment $K_4$ is inserted into the installation slot $M_2$, the end section of the film conductor section $F_{3'}$ is placed around the contact segment $K_4$ of the carrier 6 for the technical components of a door with its exposed conductors L as shown in FIG. 8*c*.

After the adhesive has hardened in the adhesive spots KL, the intermediate carrier 4 is removed from the carrier 6 for the technical components of a door such that the cable harness 5 is fixed on the carrier 6 for the technical components of a door while realizing the desired male plug connector parts $S_M$. The carrier 6 for the technical components of a door is then ready for fitting with the required electric/electronic devices.

The fitting of the carrier 6 for the technical components of a door—this applies analogously to the carrier 1—is carried out with devices that respectively contain a plug connector part $S_W$ which is realized complementary to the male plug connector part $S_M$ on the carrier 6 for the technical components of the door. The female counterpart $S_W$ with corresponding contact tabs that adjoin the upper side of the exposed conductor L of the male plug connector part $S_M$ with a certain prestress is attached to the male plug connector part $S_M$. The device is identified by the reference symbol 7 in FIG. 9 and only illustrated schematically. The device 7 lies on the carrier 6 for the technical components of a door and comprises a cable inlet channel 8 for bridging the flat conductor section $F_{3'}$. The device 7 is positioned on the carrier 6 for the technical components of a door in the position that corresponds to the position $P_2$ in FIG. 2. The device 7 is connected to the carrier 6 for the technical components of a door by means of several clip-type connectors.

Figure 10:
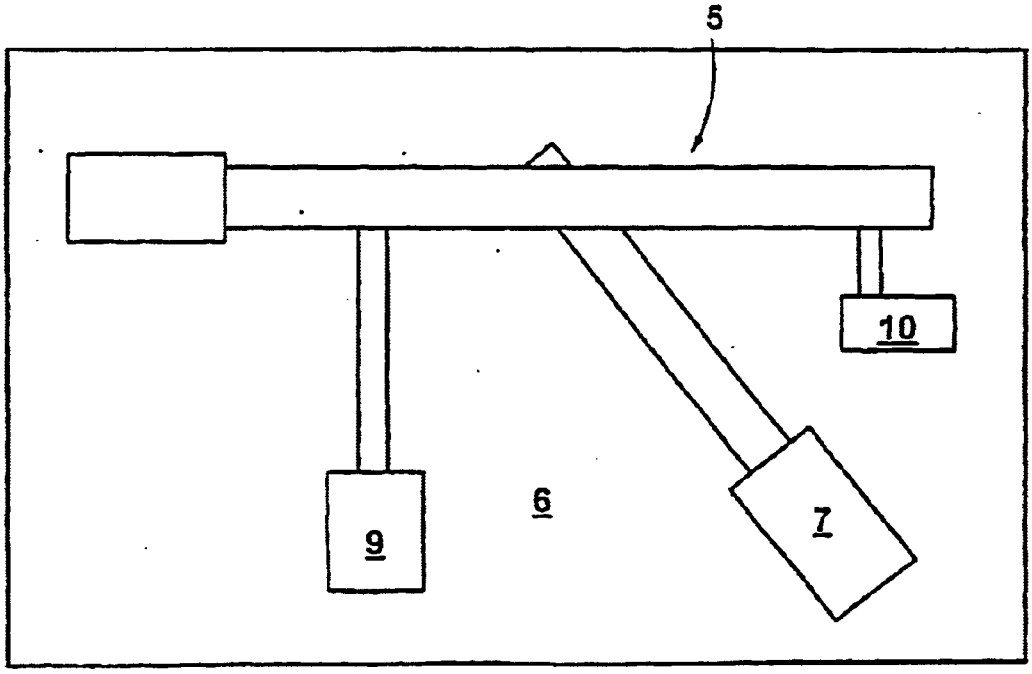

FIG. 10 schematically shows the finished carrier 6 for the technical components of a door which is fitted with the cable harness 5 and the devices 7, 9, 10. The carrier 6 for the technical components of a door which is dimensionally stable and rigid also serves as a transport and storage module for the entire arrangement before its installation into a motor vehicle door. When carrying out the described method without an intermediate carrier, the carrier also serves as a mounting table. Due to the simultaneous realization of the plug connector part assigned to the carrier 1 or the carrier 6 for the technical components of a door in which the exposed conductors L of the flat conductor sections $F_2$–$F_4$ or $F_{2'}$–$F_{4'}$ form the contact elements of the plug connector parts, it is no longer necessary to connect separate plug connector parts to the free ends of the flat conductor sections. The description also makes it clear that the mounting of the electric/electronic components 7, 9, 10 can be realized very easily. In the described snap-on mounting of the devices 7, 9, 10, for example, on the carrier 6 for the technical components of a door, the electric connection is automatically produced when the male plug connector part $S_M$ is inserted into the corresponding counterpart $S_W$.

Since the individual steps can be carried out with simple movements, the described method is, in particular, also suitable for use on a production line.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for fitting a carrier with a cable harness having flexible flat main and branch electric conductors and an electric device to be connected to a branch conductor, the method comprising:

arranging a contact element on a carrier;

exposing a top surface portion of a flexible main conductor;

exposing a bottom surface portion of a first end of a flexible branch conductor;

exposing a top surface portion of a second end of the branch conductor;

arranging the main conductor and the branch conductor in an intended configuration on the carrier with the bottom surface of the main conductor and the non-exposed bottom surface of the branch conductor lying directly on the carrier, the exposed bottom surface portion of the first end of the branch conductor lying on and contacting the exposed top surface portion of the main conductor, and the exposed top surface portion of the second end of the branch conductor being placed on the contact element of the carrier and facing away from the carrier for realizing a plug connector assigned to the carrier; and fitting the carrier with an electric device having a plug connector part realized complimentary to the contact element of the carrier such that the electric device is electrically connected to the exposed top surface portion of the branch conductor and is mechanically connected to the carrier via a mechanical and electrical connection between the plug connector part of the electric device and the contact element of the carrier.

2. The method of claim 1 wherein:

the contact element protrudes from the carrier such that the contact element is a male plug connector, wherein the plug connector part of the electric device is a female plug connector part.

3. The method of claim 1 wherein the contact element is an opening in the carrier such that the contact element is a male plug connector, wherein the plug connector part of the electric device is a male plug connector part.

4. The method of claim 1 wherein:

arranging the main and branch conductors in an intended configuration on the carrier includes fixing the main and branch conductors on the carrier.

5. The method of claim 1 further comprising:

electrically connecting the exposed bottom surface portion of the first end of the branch conductor to the exposed top surface portion of the main conductor.

6. A method for fitting an object with a cable harness having a flexible flat main electric conductor and a flexible flat branch electric conductor and an electric device to be connected to the branch conductor, the method comprising:

providing an intermediate carrier having an opening slot;

exposing a top surface portion of the main conductor;

exposing a bottom surface portion of a first end of the branch conductor;

exposing a bottom surface portion of a second end of the branch conductor;

arranging the main and branch conductors in an intended configuration on the intermediate carrier with the bottom surface of the main conductor and the non-exposed bottom surface of the branch conductor lying directly on the intermediate carrier, the exposed bottom surface portion of the first end of the branch conductor lying on and contacting the exposed top surface portion of the main conductor, and the exposed bottom surface portion of the second end of the branch conductor being placed over the opening slot of the intermediate carrier;

providing an object having a protruding contact element;

joining the intermediate carrier with an object such that the contact element of the object and the exposed bottom surface portion of the second end of the branch conductor are inserted through the opening slot of the intermediate carrier for realizing a male plug connector part assigned to the object;

transferring the main and branch conductors from the intermediate carrier to the object;

removing the intermediate carrier from being joined to the object; and fitting the object with an electric device having a female plug connector part such that the electric device is electrically connected to the exposed top surface portion of the branch conductor and is mechanically connected to the carrier via a mechanical and electrical connection between the male and female plug connector parts.

7. The method of claim 6 further comprising:

electrically connecting the exposed bottom surface portion of the first end of the branch conductor to the exposed top surface portion of the main conductor prior to joining the intermediate carrier with the object.

8. The method of claim 6 wherein:

the object is a motor vehicle door carrier.

9. An electrical system comprising:

a carrier having a contact element;

a cable harness having a flexible main conductor and a flexible branch conductor, wherein a portion of a top surface of the main conductor is exposed, wherein a portion of a bottom surface of a first end of the branch conductor is exposed, wherein a portion of a top surface of a second end of the branch conductor is exposed, wherein the main and branch conductors are arranged on the carrier in an intended configuration with the bottom surface of the main conductor and the non-exposed bottom surface of the branch conductor lying directly on the carrier, the exposed bottom surface portion of the first end of the branch conductor lying on and contacting the exposed top surface portion of the main conductor, and the exposed top surface portion of the second end of the branch conductor being placed on the contact element of the carrier and facing away from the carrier for realizing a plug connector assigned to the carrier; and an electric device having a plug connector part realized complimentary to the contact element of the carrier, the electric device fitted on the carrier such that the electric device is electrically connected to the exposed top surface portion of the branch conductor and is mechanically connected to the carrier via a mechanical and electrical connection between the plug connector part of the electric device and the contact element of the carrier.

10. The system of claim 9 wherein:

the contact element protrudes from the carrier such that the contact element is a male plug connector, wherein the plug connector part of the electric device is a female plug connector part.

11. The system of claim 9 wherein:

the contact element is an opening in the carrier such that the contact element is a male plug connector, wherein the plug connector part of the electric device is a male plug connector part.

12. The system of claim 9 wherein:

the carrier includes an opening in the region at which the exposed bottom surface portion of the first end of the branch conductor contacts the exposed top surface portion of the main conductor for enabling the main conductor and the branch conductor to be electrically connected to one another.

13. The system of claim 9 wherein:

the electric device is a vehicle door electric component.

* * * * *